United States Patent [19]

Lavorel

[11] Patent Number: 5,062,371

[45] Date of Patent: Nov. 5, 1991

[54] THERMAL REACTOR FOR HEATERS AND FUEL GENERATORS

[75] Inventor: Henri Lavorel, Sevrier, France

[73] Assignee: Efficient Thermal Reactors, Inc., Hyde Park, N.J.

[21] Appl. No.: 478,507

[22] Filed: Feb. 12, 1990

[51] Int. Cl.[5] ..... F23G 7/06; F23J 15/00

[52] U.S. Cl. ..... 110/214; 432/72

[58] Field of Search ..... 110/210, 211, 214; 432/72

[56] References Cited

U.S. PATENT DOCUMENTS 4,098,567 7/1978 Hubbert ..... 432/72

4,771,707 9/1988 Robson et al. ..... 110/214

*Primary Examiner*—Henry C. Yuen

*Attorney, Agent, or Firm*—Marvin A. Naigur

[57] ABSTRACT

A reactor for the complete combustion of gases and fuels without emissions of polluting agents, with increased efficiency of combustion, and decreased condensation on the exchange surfaces, providing greater longevity of the firebox. Turbulence of the combustion gases is induced by a coupling ring, placed between a cone and a deflector, which cause the gases to take a trajectory parallel to the generator cover of the chamber, and causes the gases to inpinge against the heat exchange surfaces, thereafter causing a more even caloric heat distribution.

8 Claims, 1 Drawing Sheet

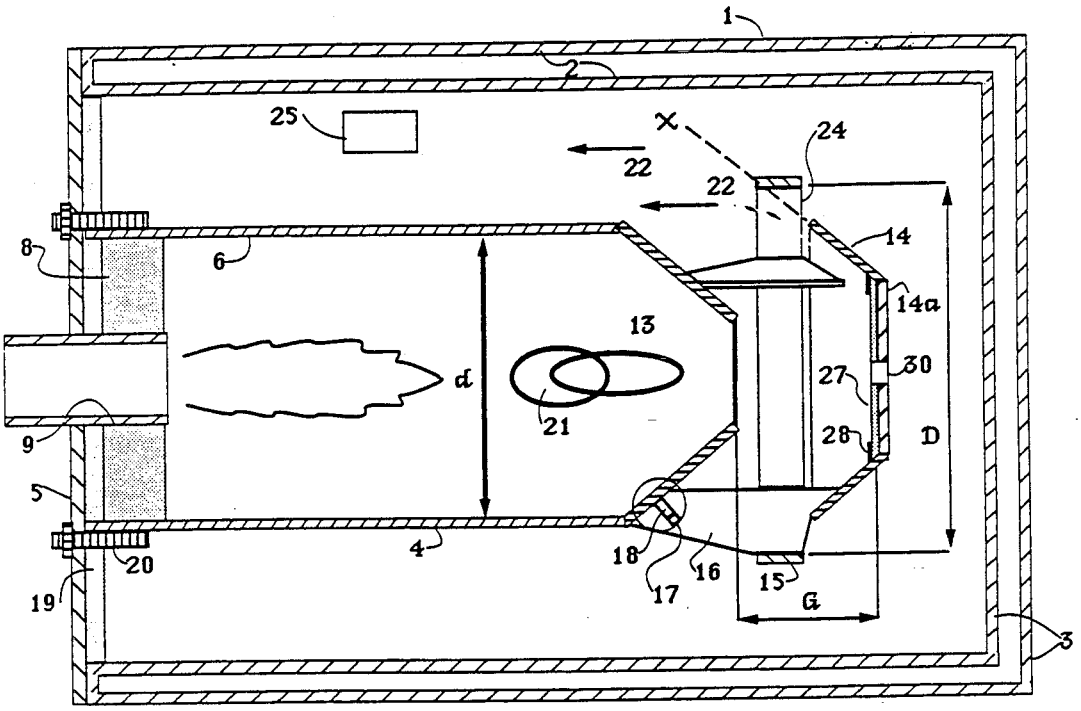
FIG.1
FIG.2
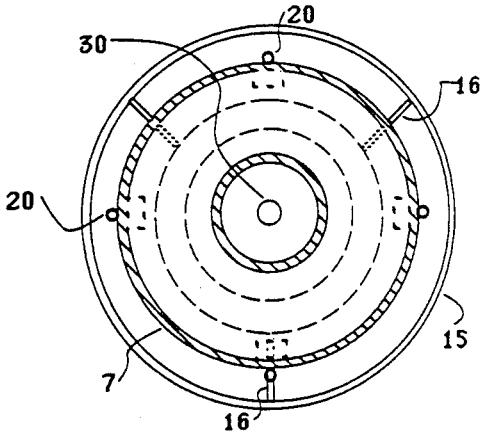
FIG.3
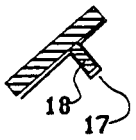

THERMAL REACTOR FOR HEATERS AND FUEL GENERATORS

BACKGROUND OF THE INVENTION

The present invention relates to an efficient thermal reactor which permits obtaining complete combustion of a combustible mixture, with increased efficiency and a reduction in the emission of pollutants.

In order to improve and control the combustion of a combustible mixture in the air and to reduce, and even to eliminate the deposition of carbon that occurs in certain portions of a burner, it is known that it is possible to alter the process of combustion inside the reactor. It is known to provide reactors which include a tubular enclosure which forms the boundary between a cylindrical tubular cover, a posterior entry wall with a central opening and an anterior incurvate with a small opening in front of a deflector. In these reactors the chamber is divided by an intermediate partition, with a peripheral passage for gases, into a chamber of combustion and an exit chamber. The intermediate partition, by forming an obstacle for the combustible gases, creates turbulence which favors the mixture of elements of combustion and permits complete combustion. This usage shows that under certain conditions, these reactors cause a significant increase in the temperature of the flame, which can attain more the 1300 degrees C. at its center, and attain a temperature which will cause the resulting combustion to emit nitrous oxide, which is a dangerous pollutant of the atmosphere.

U.S. Pat. No. 4,351,249 to Inovius discloses walls that are designed to generate vortices, and may be lined with a catalyst to cause oxidation of carbon and carbon compounds, and contains an intermediate partition. This intermediate partition, as indicated above, forms an obstacle for the gases, and causes the temperatures produced by this type of burner to become extremely elevated, to a point that the process may have to be terminated due to the high temperatures generated. In addition, these elevated temperatures may facilitate the production of unwanted gaseous pollutants, including nitric oxides. U.S. Pat. No. 4,545,430 to Betallick provides for the catalytic combustion of fuel, but this device is of a single sheet of metal in spiral form, and does not provide for the complete combustion of the gases. U.S. Pat. No. 4,515,090 to Brashears and Longwood uses primary and secondary air inputs, and does not provide for the complete combustion of the gases. The present invention provides for complete gas combustion, with almost no noxious pollutant gases being generated.

Several other types of devices have been produced in order to achieve the conversion of carbon monoxide. U.S. Pat. No. 4,181,600 to Chester requires the addition of metal particles to the mixture of gases in order to cause the combustion of carbon monoxide and hydrocarbons. However, this is an elaborate, complicated and expensive process. U.S. Pat. No. 4,115,250 to Blanton and Flanders also has the drawback that it requires the introduction of particulate catalysts as well as pressurized oxygen to the burner to achieve clean combustion. The present invention is much simpler in design, and achieves clean combustion without the requirement of adding particles of metal or compressed oxygen.

Several objects and advantages of the thermal reactor of the present invention are as follows:

(A) To create a device which is much more simple and less onerous than traditional reactors, and which provides ease of manufacture and economy of construction;

(B) To create a device which is more efficient than traditional reactors, and thus provides more heat (BTU's) for less fuel, thereby decreasing the consumption of fuel and providing a more economical reactor;

(C) to provide a reactor that permits the obtaining of complete combustion of gases without emissions of polluting agents; and (D) to provide a reactor which decreases the condensation on the heat exchange surfaces, and thereby provide greater longevity of the firebox.

SUMMARY OF THE INVENTION

In accordance with an illustrative embodiment demonstrating features and advantages of the present invention, there is provided a thermal reactor for enhancing combustion and reducing the emission of pollutants. A burner chamber bounded by a cylindrical wall and a rear wall formed from refractory material and with a central opening for introducing gases of combustion. A conical nose section is formed with an exit orifice for the gases of combustion, on the end of the burner chamber. Positioned spaced-apart from and coextensive with the conical nose section is a frusto-conical shaped deflection means for directing gases of combustion toward the nose section. Means coaxial with the burner chamber are positioned between the burner chamber and the deflection means, for coupling the burner chamber and the deflection means, whereby prior to exiting the burner chamber, the gases are placed in turbulence and after exiting the burner chamber the gases are reduced in velocity and change direction toward the burner chamber.

BRIEF DESCRIPTION OF THE DRAWINGS

The above brief description, as well as further objects, features, and advantages of the present invention will be more fully appreciated by reference to the following detailed description of presently preferred but a nonetheless illustrative embodiment in accordance with the present invention, when taken in connection with the accompanying drawings wherein:

FIG. 1 is a transverse sectional view of the firebox and fuel burner in accordance with the present invention; and FIG. 2 is a side elevational view of the fuel burner shown in FIG. 1.

FIG. 3 is an enlarged sectional view of the portion of the burner cone encircled in FIG. 2.

DESCRIPTION OF THE PREFERRED EMBODIMENT

With reference to FIG. 1, there is shown in a general fashion a firebox 1 bounded by thermal heat exchange surfaces 2, 3, and 4 and by a firebox plate 5. A combustion chamber 6, is centrally located in the firebox 1 and is composed of a cylindrical tubular cover 7 with a posterior partition 8, made of refractory material which has a central tube opening 9. In order to allow for passage of gases through the combustion chamber 6 there is provided an anterior cone 12 formed with an orifice 13 to allow for the exit of the gases. Facing the cone 12 is a deflector 14, of the same general conical shape and the same external diameter as the cone 12, which has a diametrical side 14*a*. In accordance with the invention, the method of generating turbulence in the combustion chamber 6, comprises a cylindrical coupling ring 15, which is positioned in the firebox 1 coaxial with the cover 7, between the cone 12 and the deflector 14. More specifically, the coupling ring 15 is placed in proximity to, but at a set distance from, the deflector 14, and in such a way that its walls are in the trajectory of the gases which are represented by the broken line, designated by the letter X. The coupling ring 15 acts as a linkage and has an interior diameter D that is greater than the exterior diameter d of the cover 7, and is held by longitudinal brackets 16, which also hold the deflector 14. The brackets 16 are formed with slots 17 for receiving plates 18 that are welded to the cone 12. The deflector 14 is also welded to the end of the brackets 16, and as shown in FIG. 2, three brackets 16 are provided. This arrangement permits the relative position of the elements to be maintained no matter what the expansion and temperature present in the combustion chamber 6. The cover 7 is fixed to a partition 19 which is juxtaposed to the firebox plate 5 by a number of thin shank studs 20, that are jointed to the cover 7, and traverse the firebox plates 5 and the partition 19 in order to receive the appropriate studs 20.

Functionally, the hot gases exit through the orifice 13 in combustion chamber 6 and then are sent by the deflector 14 in the direction of the cylindrical coupling ring 15. The coupling ring 15, which is in the trajectory of the gases causes a breaking action which tends to produce within the combustion chamber 6, a zone of compression which is designated by reference numeral 21 in FIG. 1. The compression zone 21 generates by itself, at the interior of the combustion chamber 6, the turbulence which is necessary to ensure the mixture of the unburned substances with the hot gases and thereby obtain the complete combustion that is sought. As is shown by the directional arrows 22 in FIG. 1, via the posterior end, the coupling ring 15, provides for both the deflection and return of the hot gases that come out of the combustion chamber 6 in the direction of the firebox plate 5, by making the gases course via a trajectory which is parallel to the cover 7, and also parallel to other heat exchange surfaces. This circulation is favorable for thermal heat exchange, and allows for obtaining a more uniform caloric distribution on the heat exchange surfaces, while at the same time preventing condensation from forming on these surfaces.

An area of low pressure is created in an anterior zone 24, of the coupling ring 15, which assures the recirculation of gases in the combustion chamber 6 and as shown by directional arrows 22, these gases mix with the hot gases and return to the heat exchange circuit before escaping via an exhaust pipe 25. This last aspect is especially important because by itself it prevents the loss of efficiency that is due to the too rapid escape of the hot gases, in a proportion of the order of 30 to 35 percent. Against the far end 14*a* of the deflector 14, ceramic fiber material 27 is fixed, the support of which is assured by the brackets 28. It is preferable to fabricate the ceramic fiber material 27 with a width dimension of 12 mm. In instances where there is poor atomization of the combustible liquid at the nozzle cone 12, the turbulence may not suffice to permit a good mixing with the air. Therefore, the ceramic material 27 completes combustion of unburnt particles by contact of these particles with the fibers on the surface of the material 27, which becomes incandescent, as soon as the burner is turned on.

In accordance with the foregoing, it can be appreciated that the burner of the present invention is much more simple than traditional reactors, and presents a much greater number of advantages than other traditional reactors, while improving the function of the burner considerably. In the operation of the burner of the present invention, the method of inducing turbulence of the gases in the combustion chamber 6 is performed by the coupling ring 15 placed between the cone 12 and the deflector 14 in coaxial alignment with the enclosure, within a set distance from such a deflector, and in a manner such that its cylindrical walls are in the trajectory of the gases that are returned by the deflector 14 and generate an area of low pressure which causes the gases to return to the firebox 1. This combination, of the coupling ring 15 to the cone 12 and deflector 14, assures three functions, the first of which is to slow down the exit speed of the gases leaving the reactor in order to form, a zone of compression which creates turbulence in the combustion chamber 6. The second function is cause a deviation of the gases which come from the deflector 14 in order to cause these gases to follow a trajectory which is essentially parallel to the cover 7 of the combustion chamber 6 and impinges against the plate of firebox 1, thus ensuring a more even caloric distribution on the heat exchange surfaces. The third and last function is obtained by virtue of the creation of an area of low pressure, to aspirate the gases that are circulating in the firebox 1, but which have not yet given up all their heat calories, in order to send them in the direction of the heat exchange surfaces, thus improving the efficiency in the combustion chamber 6. It follows from the above, that the burner according to the present invention, permits not only the suppression of unburned substances in the gases, but also improves the thermal output, and for a given caloric value, reduces the consumption of fuel.

It should be understood that the dimensions of the burner depend on the caloric values of the burner, and this is generally defined in accordance with the consumption of fuel, expressed in kilograms per hour. The volume of the combustion chamber 6, must have a value equal to 3.5 $cm^3$ per kilogram of fuel consumed per hour, of the section of the exit area of the orifice 13 which is in the order 0.2 $cm^2$ per kilogram per hour of fuel consumed, and the distance G between the extremity of the coupling ring 15 and the end of the deflector 14 of which the value is of the order of 0.75 times the diameter of the hole of the exit orifice 13. No matter what the dimensions of the burner, experiments have shown that the coupling ring 15, should have a length of 20 mm, an interior diameter D, which is greater than the exterior diameter d of the cover 7, which is on the order of 30 mm, and should be axially displaced from the posterior side of the deflector by a value on the order of 5 mm.

In certain applications, especially when the burners are very powerful, the coupling ring 15 provides too great a breaking action for the gases, by virtue of design, construction and position requirements of the various elements of the thermal reactor, and to prevent this breaking action, an accessory exit opening 30 is formed in the deflector 14, on the partition 14*a*. From the foregoing it has been shown that the burner of the present invention, permits not only the obtaining of complete combustion of gases without emissions of polluting agents, but also permits the reduction of consumption of fuel, and decreases the condensation on the heat exchange surfaces, thereby providing greater longevity of the firebox 1. Furthermore, additional advantages are achieved in that the present invention permits: the creation of a device which is much more simple and less onerous than the traditional reactors; the manufacture of the invention affords ease and economy of fabrication; the operation of applicant's burner permits cleaner combustion of fuels, thereby contributing to the national goal of development of methods of combustion which allow for waste disposal without adding contaminants to the atmosphere; and the present invention also facilitates the conservation of fossil fuels by virtue of more economic and efficient combustion process.

Additional modifications, changes and substitutions are intended in the foregoing disclosure, and, in some instances, some features of the invention will be employed without corresponding use of other features. Accordingly, it is appropriate that the appended claims be construed broadly and in a manner consistent with the spirit of the invention herein.

What is claimed is:

1. A thermal reactor for enhancing combustion and reducing the emission of pollutants comprising:

a burner chamber bounded by (a cylindrical) an enclosure wall and a rear wall formed from refractory material and with a central opening for introducing gases of combustion;

a conical nose section, in the form of an inwardly diverging restriction, with the base of said nose section mounted on said enclosure wall at the open end thereof and the apex of said nose section formed with an exit orifice for said gases of combustion, on the end of said burner chamber;

(frusto conical shaped deflection) inwardly diverging restriction means spaced apart from and coextensive with said conical nose section directing said gases of combustion toward said nose section; and means coaxial with said burner chamber positioned between said burner chamber and said restriction means for coupling said burner chamber and said restriction means, whereby prior to exiting said burner chamber said gases are places in turbulence, and after exiting said burner chamber said gases are reduced in velocity and change direction toward said burner chamber.

2. A thermal reactor according to claim 1, in which said means coaxial with said burner chamber comprises (an annular ring) annular restriction means mounted onto said conical nose section.

3. A thermal reactor according to claim 1, in which said annular (ring) restriction means is formed with an internal diameter which is larger than the internal diameter of said burner chamber.

4. A thermal reactor according to claims 2 and 3, in which a plurality of brackets are mounted at the exterior of said nose section, and said annular (ring) restriction means and said (deflection) inwardly diverging restriction means (are) mounted on said brackets.

5. A thermal reactor according to claim 4, in which said deflection means is shaped to conform to said conical nose section, and is mounted on said brackets in a spaced-apart position with respect to said nose section.

6. A thermal reactor according to claim 5, in which a ceramic circular disk is mounted within said deflection means.

7. A thermal reactor according to claim 6, in which said deflection means and said circular disk are formed with a through opening.

8. A thermal reactor according to claim 1, in which a firebox chamber is provided for mounting said burner chamber.

* * * * *

UNITED STATES PATENT AND TRADEMARK OFFICE

CERTIFICATE OF CORRECTION

PATENT NO. : 5,062,371

DATED : November 5, 1991

INVENTOR(S) : Henri Lavorel

It is certified that error appears in the above-identified patent and that said Letters Patent is hereby corrected as shown below:

On the title page, Item [73] "Hyde Park, NJ" should be --Hyde Park, NY--

Signed and Sealed this

Sixteenth Day of March, 1993

*Attest:*

STEPHEN G. KUNIN

*Attesting Officer*

*Acting Commissioner of Patents and Trademarks*